US008366075B1

(12) United States Patent
Provines

(10) Patent No.: US 8,366,075 B1
(45) Date of Patent: Feb. 5, 2013

(54) PRY BAR SLIDING FULCRUM ASSEMBLY

(76) Inventor: Wynn Provines, Vandalia, IL (US)

( * ) Notice: Subject to any disclaimer, the term of this patent is extended or adjusted under 35 U.S.C. 154(b) by 597 days.

(21) Appl. No.: 12/688,606

(22) Filed: Jan. 15, 2010

Related U.S. Application Data

(63) Continuation-in-part of application No. 12/069,835, filed on Feb. 12, 2008, now Pat. No. 7,673,848.

(51) Int. Cl.
*B66F 15/00* (2006.01)

(52) U.S. Cl. ..... 254/25; 254/21; 254/131

(58) Field of Classification Search ..... 254/21–27, 254/28, 131, 131.5, 1
See application file for complete search history.

(56) References Cited

U.S. PATENT DOCUMENTS

| | | | | |
|---|---|---|---|---|
| 148,664 | A | 3/1874 | Buell | |
| 166,818 | A * | 8/1875 | Shaw | 254/25 |
| 643,512 | A * | 2/1900 | Lubbock | 254/27 |
| 765,246 | A * | 7/1904 | Muir | 254/27 |
| 785,020 | A * | 3/1905 | Pearson | 254/27 |
| 900,338 | A * | 10/1908 | Wolfe | 254/27 |
| 949,337 | A * | 2/1910 | Trogner | 254/25 |
| 1,782,506 | A | 11/1930 | Henderson | |
| 2,061,754 | A * | 11/1936 | Casey | 254/25 |
| 2,253,100 | A | 8/1941 | Sprague | |
| 2,556,343 | A | 6/1951 | Shearer | |
| 2,776,108 | A | 1/1957 | Sherman | |
| 2,907,106 | A | 10/1959 | Lockwood | |
| 4,042,210 | A | 8/1977 | Feldmann | |
| 7,673,848 | B1 * | 3/2010 | Provines | 254/25 |
| 2006/0108570 | A1 | 5/2006 | Del Favero | |

* cited by examiner

*Primary Examiner* — Lee D Wilson
(74) *Attorney, Agent, or Firm* — Kevin L. Klug

(57) ABSTRACT

A pry bar sliding fulcrum assembly having a fulcrum and saddle which slidably mates with a conventional prybar and which provides a greater force onto a work material than the conventional prybar alone. The pry bar sliding fulcrum assembly easily and quickly slides away from the work material when a conventional prybar function is desired and slides toward the work material when an enhanced application force or greater prybar end displacement is required. The assembly uniquely mates with or is held with the prybar end whereby the assembly retains a static position relative to the prybar during use.

17 Claims, 27 Drawing Sheets

PRY BAR SLIDING FULCRUM ASSEMBLY

This application claims priority of U.S. Provisional Patent Application No. 60/901,610, filed Feb. 13, 2007, entitled Pry Bar Sliding Fulcrum Assembly. This application is a Continuation-in-Part of U.S. patent application Ser. No. 12/069,835, filed on Feb. 12, 2008.

BACKGROUND OF THE INVENTION

The art of the present invention relates to prybars in general and more particularly to a pry bar fulcrum assembly which slidably mounts with and onto a conventional prybar and allows a user to obtain a greater and a more optimally placed prying force and displacement during use. The slidability of the present art allows the user to slide the fulcrum assembly rearward whereby the prybar may be utilized in a conventional manner.

Conventional prybars typically comprise a handle, a lever shaft mounted with said handle, and a broadened or cleft end mounted with said shaft via a bend between said end and said shaft. The present art uniquely fits with the aforesaid conventional prybars and provides an adjustable fulcrum which allows a user to obtain the optimum leverage onto the object upon which said end is working. The present art is optimally fitted with a prybar having a rectangular shaft cross section yet in slightly modified form may be utilized with shafts of any cross section.

The preferred embodiment of the present invention comprises a fulcrum having an optimal cross sectional shape, a saddle, a retainer, and a spring. The fulcrum comprises a plate material having two sides and also having a front wall, a rear wall, a bar mating wall, a surface mating wall, a spring indentation, and a pivot hole. In the preferred embodiment, the bar mating wall has a shape which uniquely mates with the aforesaid pry bar bend between said end and said shaft and the cross section of the prybar shaft. The at least partially arcuate or "V" shaped form of said bar mating wall provides an optimum retention of the fulcrum near or at the pry bar end during use. That is, the fulcrum will not have a substantial movement during use as it substantially seats with the pry bar bend or is held by associated elements. In the preferred embodiment nearest said rear wall, the surface mating wall is substantially flat in order to follow the straight line contour of the pry bar shaft with alternative embodiments having a plurality of shapes.

An alternative embodiment of the present invention does not require the fulcrum bar mating wall to substantially mate with or have a substantial mirror image of the pry bar bend. The alternative embodiment utilizes a cam lock between the saddle and the prybar lever shaft in order to secure the assembly at a location desired by the user or other locking mechanisms as described herein.

All embodiments of the present invention allow a user to impart substantially more tip force to a work area than with traditional prybars and in a manner which is substantially quicker, more convenient, and versatile than prior art prybar assist devices. That is, the present art fulcrum places the pivot point location nearer the broadened end of the prybar which increases the moment arm of the handle and shaft and decreases the moment arm of the broadened end, thereby placing a greater force upon the broadened end relative to the applied handle force. Furthermore, the present art provides a greater range of displacement at the broadened end due to the fulcrum thickness inserted between the prybar and the underlying base material. Unique to the present invention is the ability of the fulcrum assembly to quickly and easily slide rearward on the prybar shaft, while remaining attached, and allow conventional utilization of the prybar.

Accordingly, it is an object of the present invention to provide a pry bar sliding fulcrum assembly in combination with a conventional pry bar which easily and quickly adjusts to a user's desired position and provides considerably more work force and displacement than conventional prybars.

Another object of the present invention is to provide a pry bar sliding fulcrum assembly which may be easily and quickly installed and used with conventional prybars.

A further object of the present invention is to provide a pry bar sliding fulcrum assembly which is easily removed from the work area while remaining attached to a prybar whereby the prybar may be utilized in a conventional manner.

SUMMARY OF THE INVENTION

In accordance with the present invention, the preferred embodiment represents an adjustable fulcrum assembly comprising a fulcrum having an optimal cross sectional shape, a saddle, a retainer, and a spring. A first and second alternative embodiment utilizes a cam lock mounted with and/or between the saddle and lever shaft opposite the fulcrum in order to secure the adjustable fulcrum assembly at a desired location on the prybar shaft. A third alternative embodiment utilizes a bar mating wall spacer between the bar mating wall and the lever shaft or broadened end whereby a greater displacement at the prybar end is obtained.

In all embodiments, the fulcrum portion of the assembly comprises a plate material having two sides and also having a front wall, a rear wall, a bar mating wall, and a surface mating wall. The preferred embodiment also has a pivot hole and a spring indentation on the bar mating wall. The preferred embodiment of the bar mating wall also has a shape which uniquely mates with the aforesaid pry bar bend between the end and the shaft. The bar mating wall form provides an optimum retention of the fulcrum near or at the pry bar end during use. That is, the fulcrum will not have a substantial movement during use as it substantially seats with the pry bar bend. In the preferred embodiment nearest the rear wall, the surface mating wall is substantially flat in order to follow the straight line contour of the pry bar shaft.

An alternative embodiment of the present invention does not require the bar mating wall to have a substantial mirror image of the pry bar bend or intimately conform to the prybar bend contour. The alternative embodiment utilizes a cam lock on the saddle of the sliding fulcrum assembly in order to secure the assembly at a location desired by the user. The alternative embodiment is especially useful with prybars which are not manufactured with a specifically defined angle between the shaft and broadened end. The alternative embodiment further allows fulcrum attachment with the assembly via welding, fasteners, or other structurally attached methods.

The surface mating wall also has an at least partially arcuate form which allows a smooth rotation or pivot of the pry bar when the surface mating wall contacts a base surface relative to which a prying force is imparted upon said broadened end and work material.

In a preferred embodiment, the fulcrum is held with said pry bar via a saddle which mounts or mates over said shaft and is secured with said fulcrum via a retainer such as a pin or bolt. That is in a preferred embodiment, the fulcrum has a proximal pivot hole through said plate sides nearer said rear wall than said front wall through which a pin or bolt is placed through said saddle and said fulcrum to slidably secure said saddle and fulcrum with said pry bar. An alternative embodiment may attach the fulcrum to the saddle with welds or other more permanent bonding techniques and place a pin or bolt through the saddle and cam lock opposite said fulcrum.

In the preferred embodiment, between said bar mating wall and said pry bar shaft and positioned between said rear wall and an axis through said proximal hole which is perpendicular to said shaft is placed a spring. The spring assures and provides a positive mating force between said bar mating wall and said pry bar due to the pivoting capability of the fulcrum and/or the spring contact. The force assures that the assembly is frictionally held and not loosely mated with the pry bar whereby the assembly will hold at any point when slid.

The aforesaid preferred embodiment arrangement requires that when seated with said bend, the bar mating wall at or aft of said proximal hole have a gap between said shaft and said bar mating wall. The gap allows said fulcrum to pivot on said retainer when the assembly is retracted from the bend portion. If a gap was not present, the bar mating wall nearest said rear wall would bind with the shaft and preclude sliding of the assembly.

The third alternative embodiment utilizes one or more bar mating wall spacers which are conveniently stowed upon a head or shaft of a saddle set screw when not utilized. The spacers provide an even greater displacement between the surface mating wall and the axis of the lever shaft, thereby further increasing the range of displacement at the broadened end when the pry bar is utilized. That is, mathematically the range of displacement is increased by at least the increased separation of the surface mating wall from the from the prybar lever shaft. The set screw or a spring between the saddle and the lever shaft provides a compressive force onto the spacer in order to hold it into place and provide the positive retention of the adjustable fulcrum assembly.

The present art assembly may be manufactured from a plurality of materials including metallic materials such as steel or aluminum, plastics, composites, woods, and other materials capable of withstanding the compressive and lateral forces of the pry bar. In the preferred embodiment, the assembly is manufactured from a carbon steel.

BRIEF DESCRIPTION OF THE DRAWINGS

Numerous other objects, features, and advantages of the invention should now become apparent upon a reading of the following detailed description taken in conjunction with the accompanying drawings, in which.

DETAILED DESCRIPTION

Figure 1:
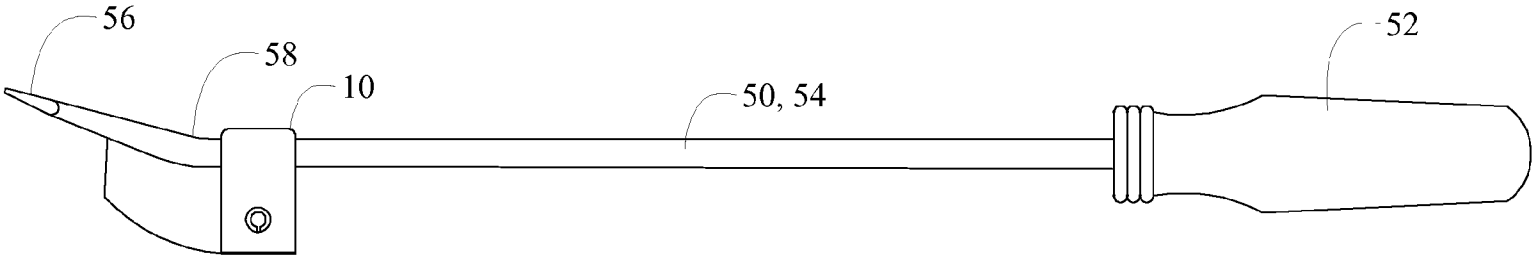
FIG. 1 is a left side plan view of a preferred embodiment of the pry bar sliding fulcrum assembly mounted with a pry bar.
Figure 2:
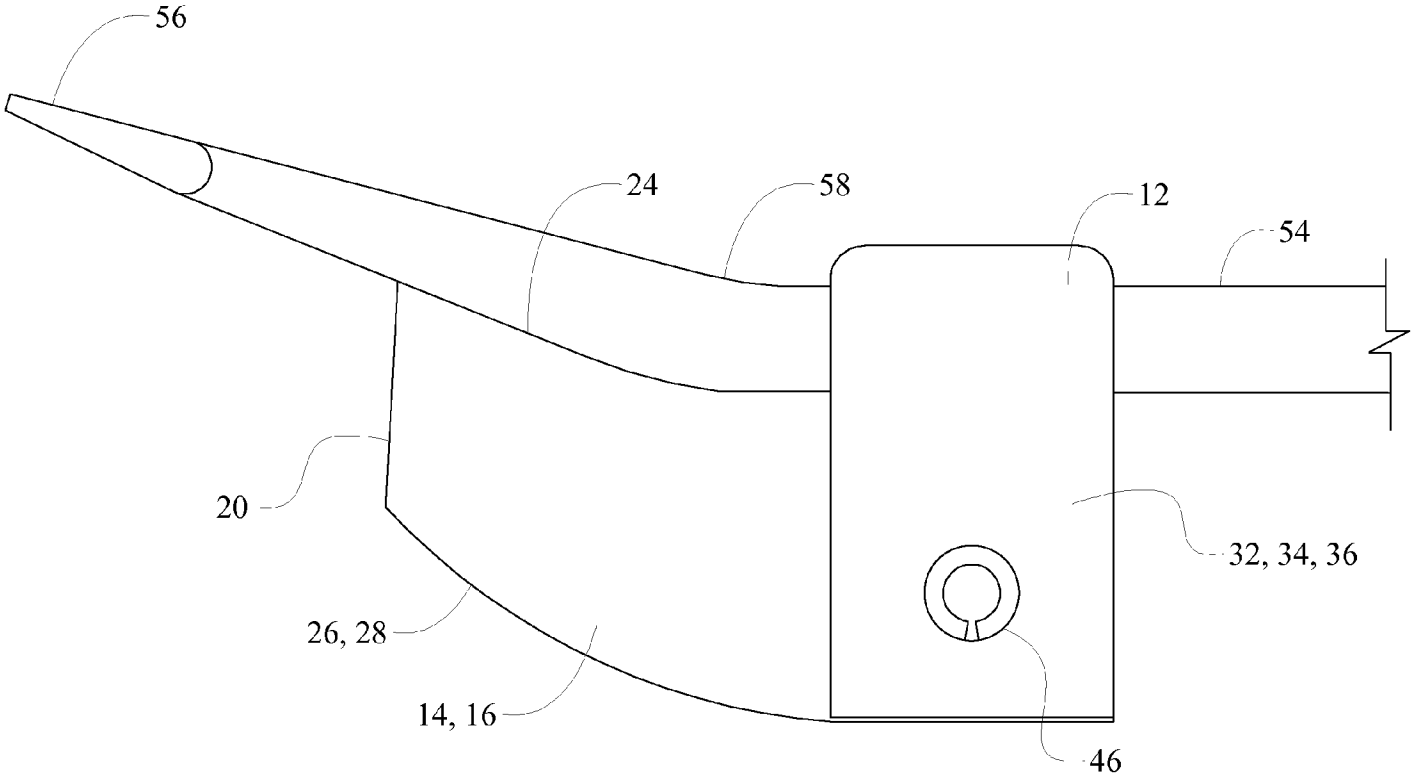
FIG. 2 is an exploded view of the end portion thereof.
Figure 3:
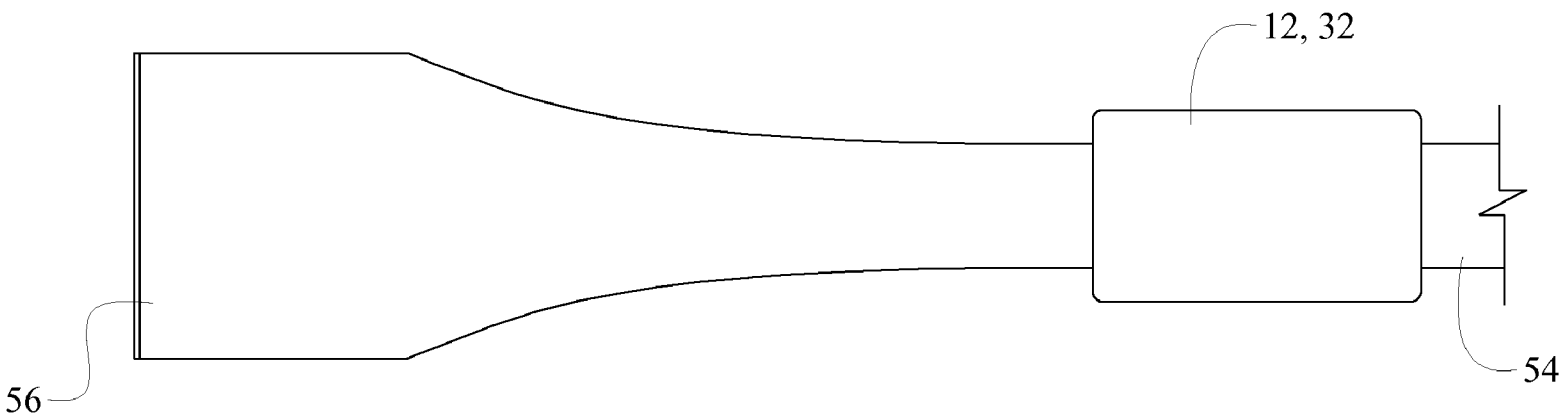
FIG. 3 is a top side plan view of the end portion of FIG. 2.
Figure 4:
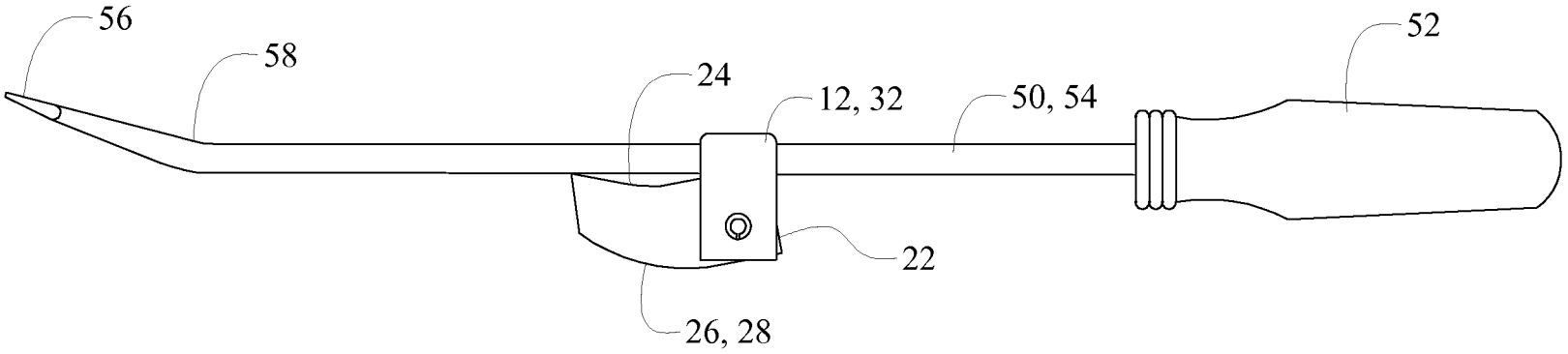
FIG. 4 is a left side plan view of the pry bar sliding fulcrum assembly retracted and mounted with a pry bar.
Figure 5:
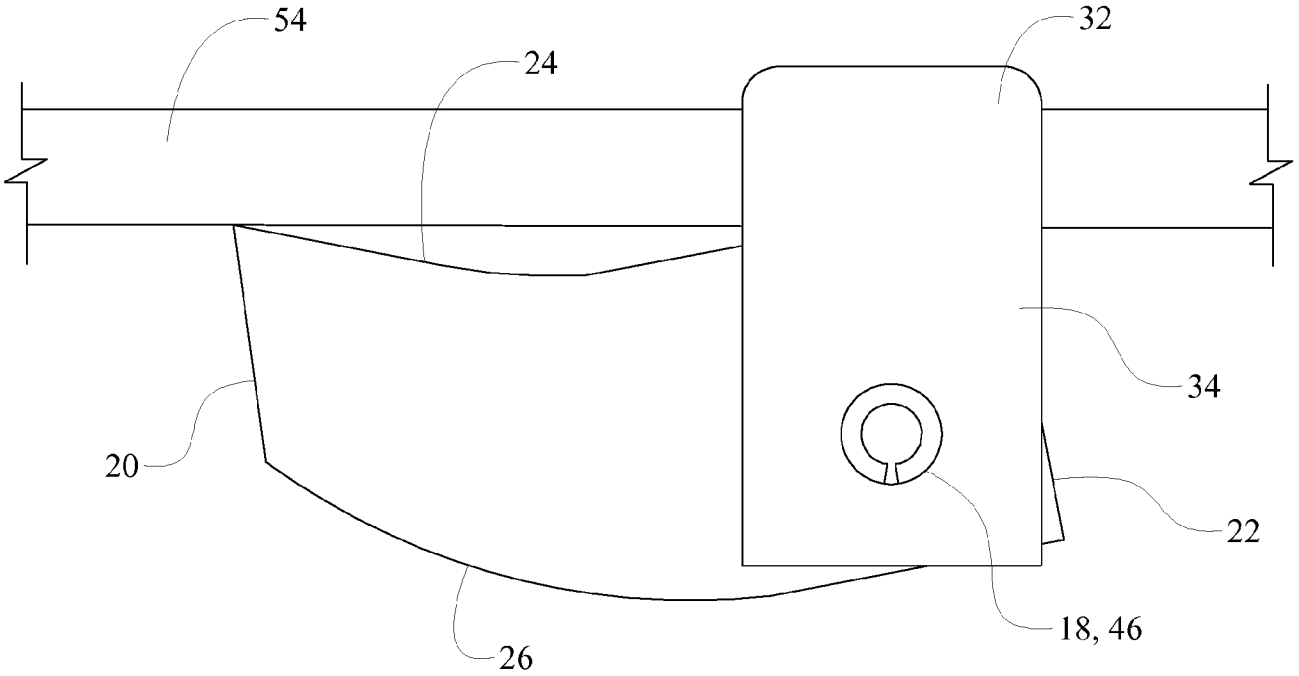
FIG. 5 is an exploded view of the pry bar sliding fulcrum assembly as depicted in FIG. 4.
Figure 6:
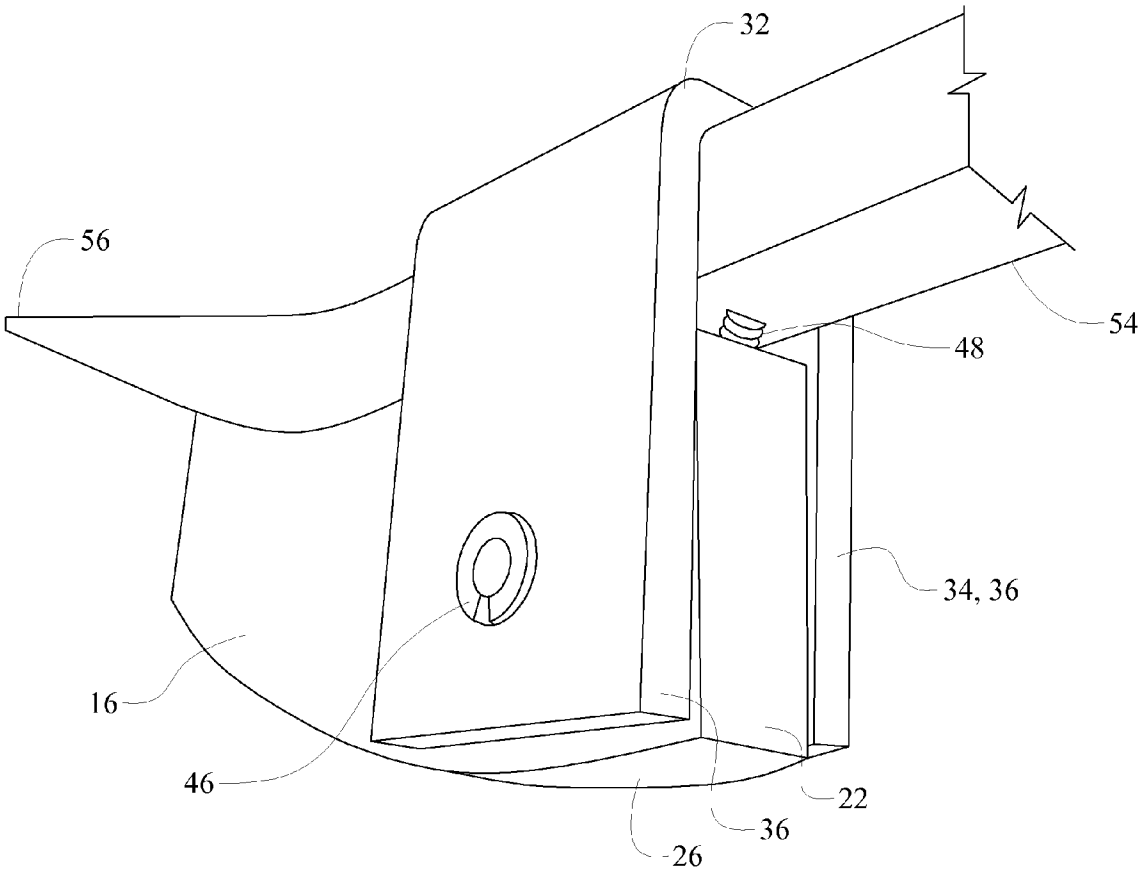
FIG. 6 is a rear perspective view of the exploded view of FIG. 2.
Figure 7:
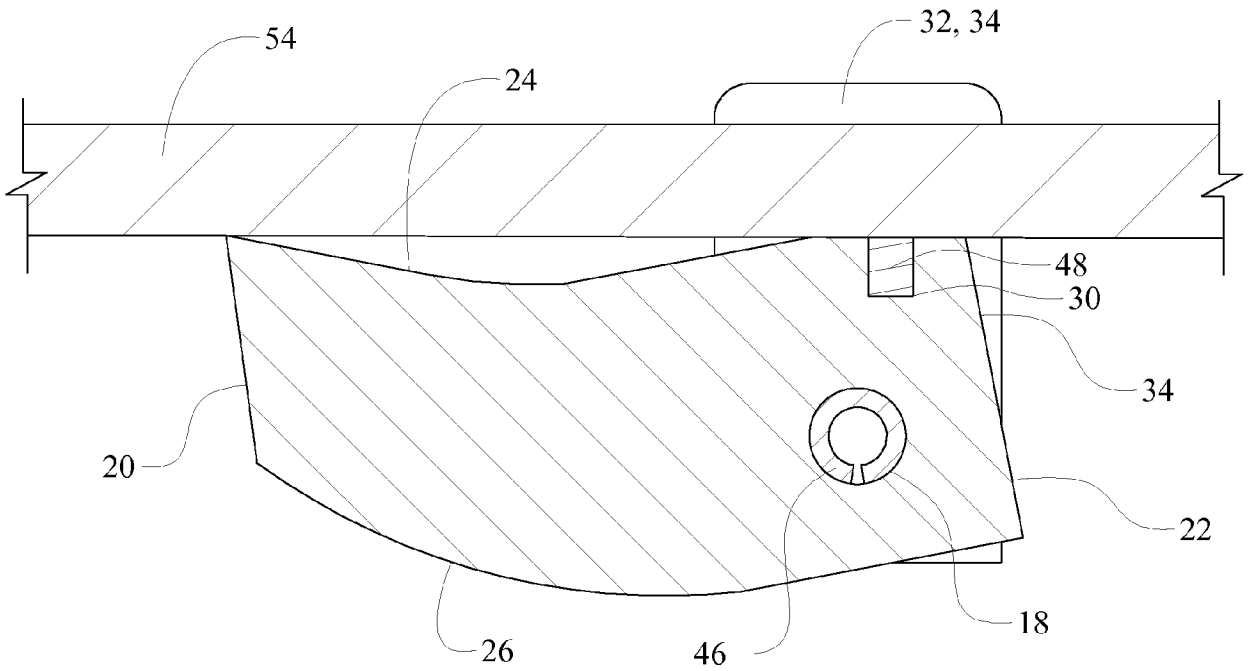
FIG. 7 is a cross sectional view of FIG. 5 taken along the shaft central axis.
Figure 8:
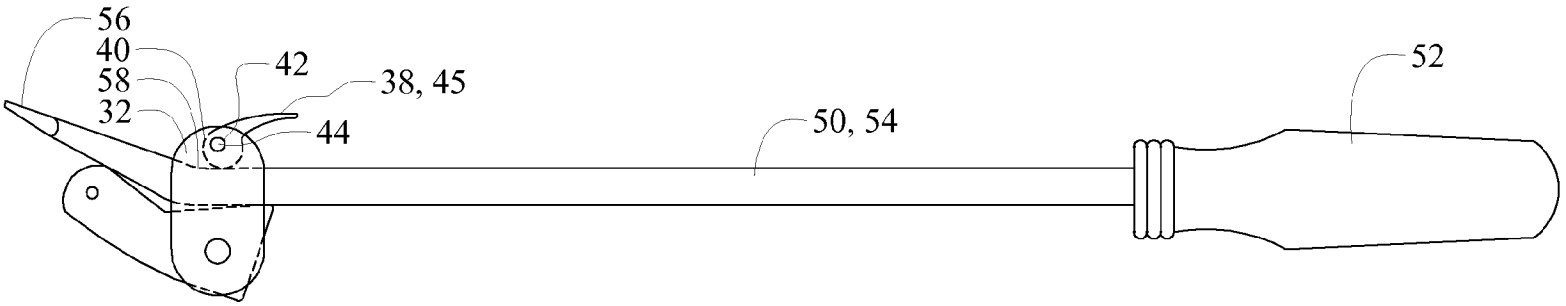
FIG. 8 is a left side plan view of a first alternative embodiment of the pry bar sliding fulcrum assembly mounted with a pry bar and showing portions of the fulcrum and cam lock in phantom.
Figure 9:
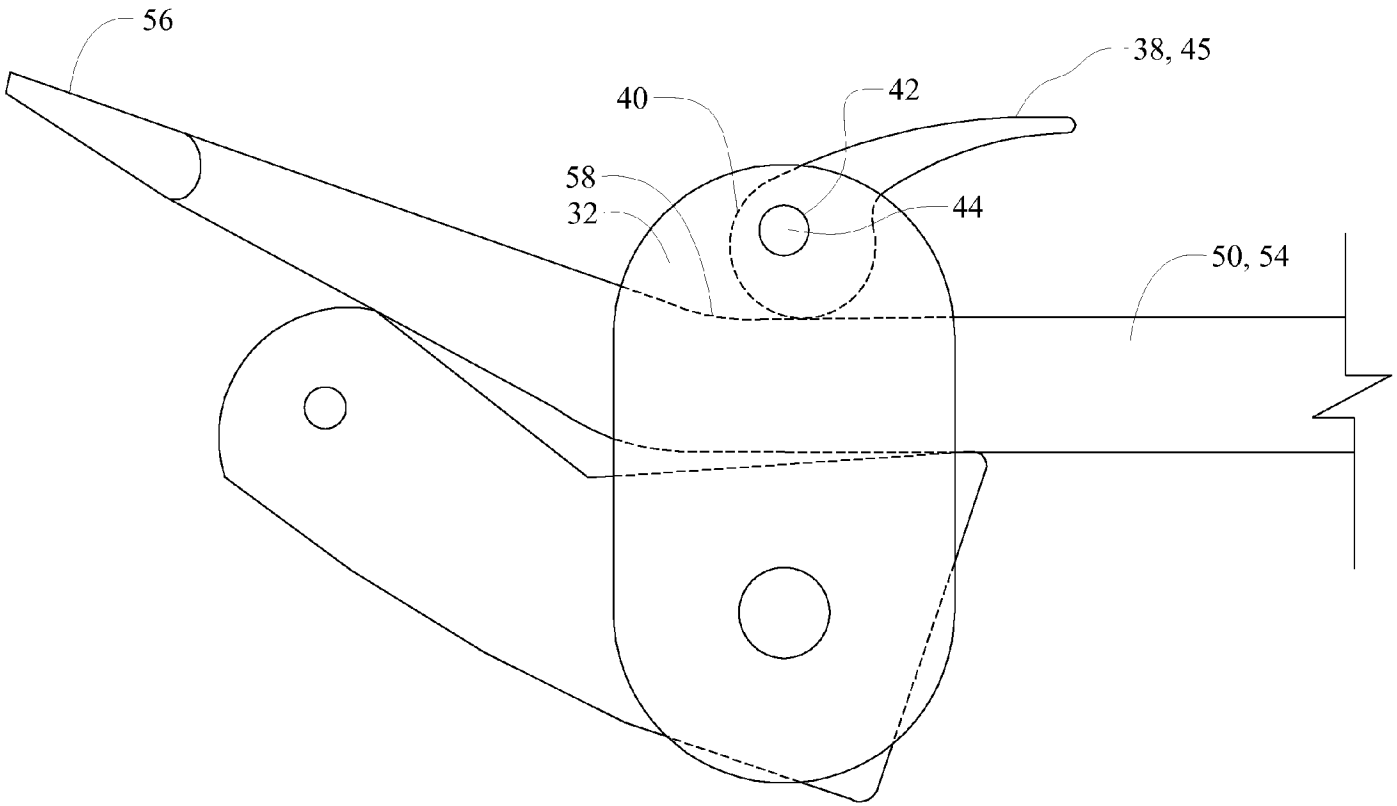
FIG. 9 is an exploded view of the end portion thereof.
Figure 10:
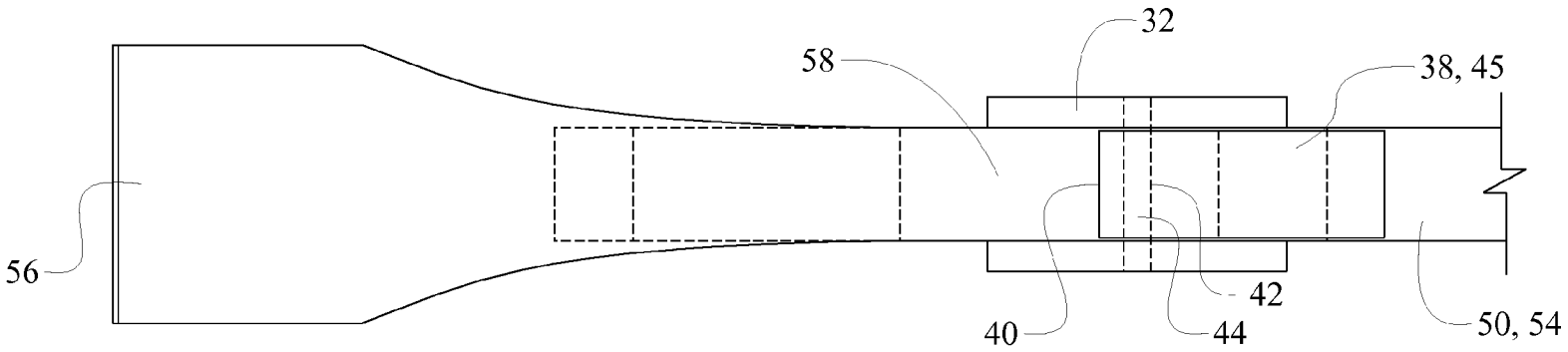
FIG. 10 is a top side plan view of the end portion of FIG. 9.
Figure 11:
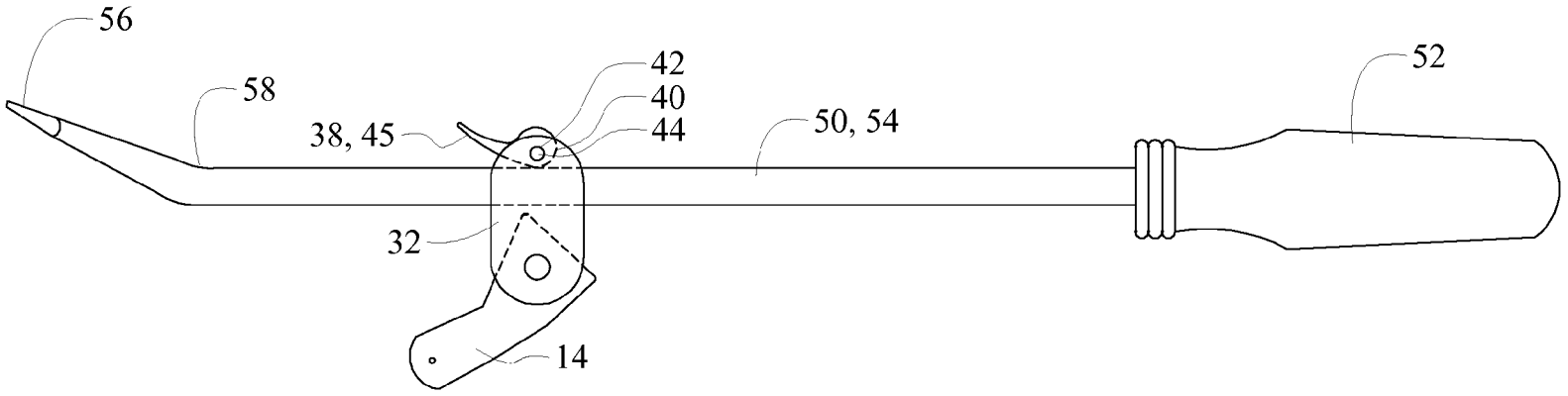
FIG. 11 is a left side plan view of the first alternative embodiment pry bar sliding fulcrum assembly retracted and mounted with a pry bar.
Figure 12:
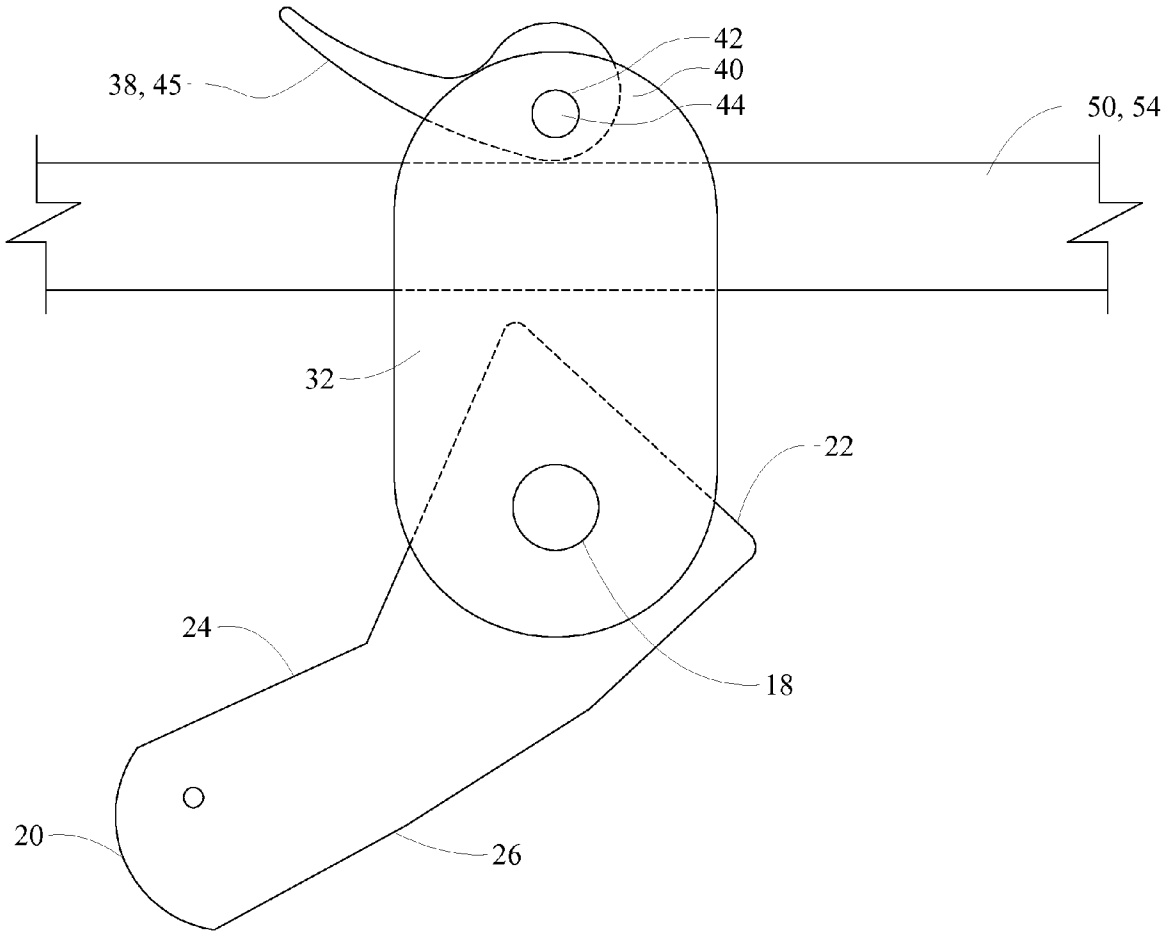
FIG. 12 is an exploded view of the pry bar sliding fulcrum assembly as depicted in FIG. 11.
Figure 13:
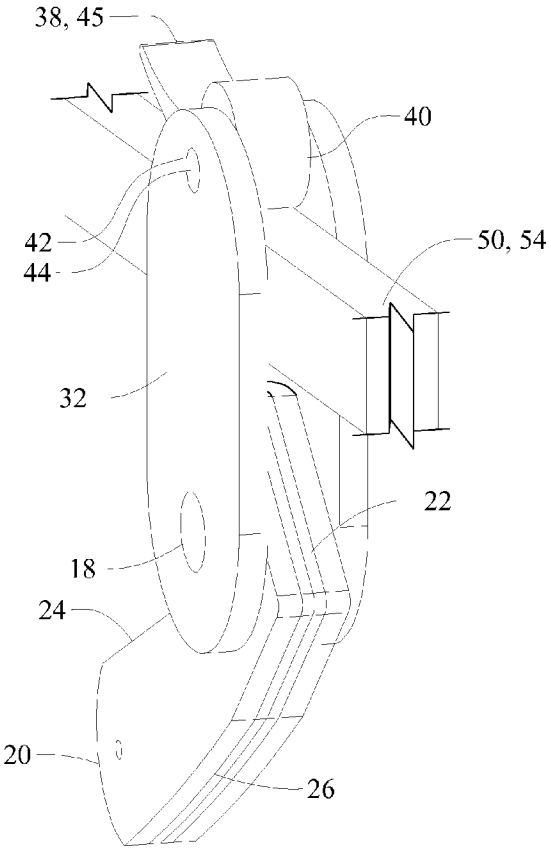
FIG. 13 is a rear perspective view of the exploded view of FIG. 12.
Figure 14:
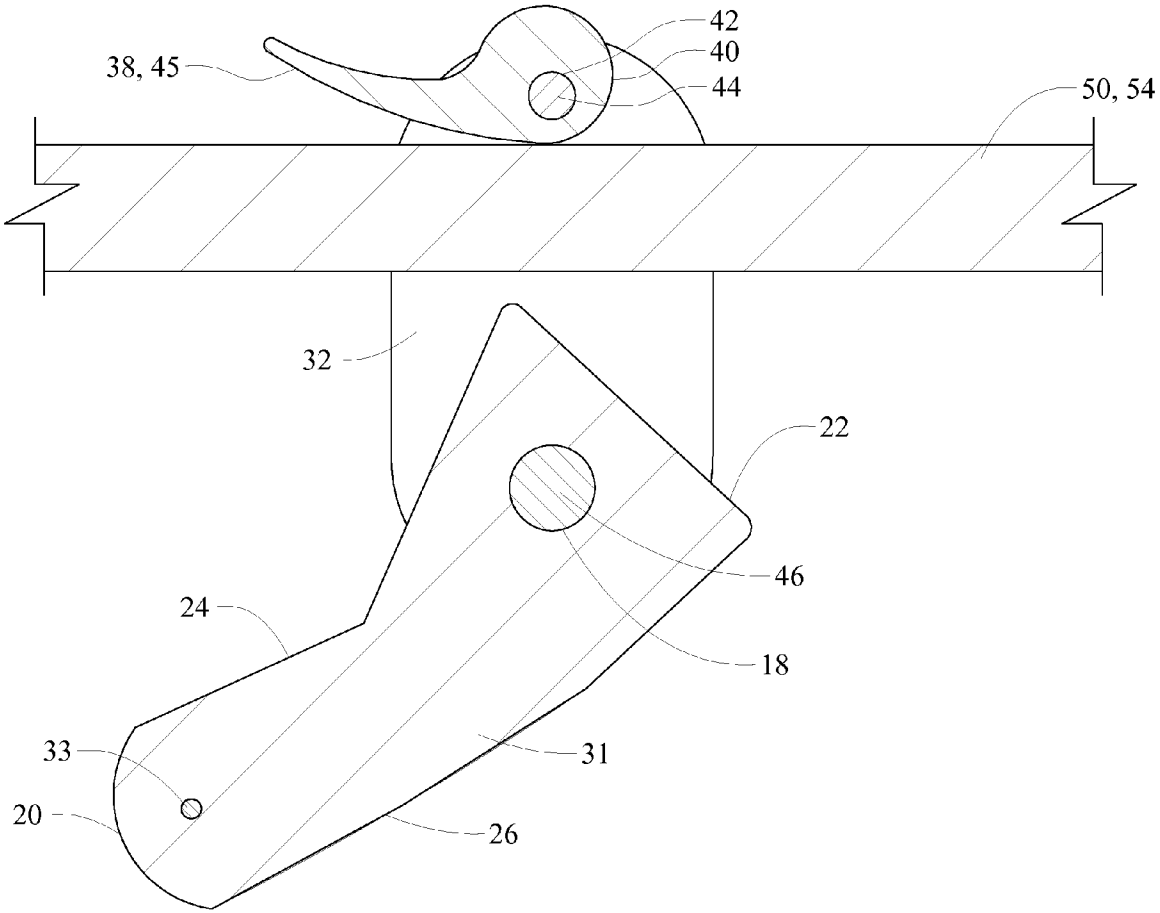
FIG. 14 is a cross sectional view of FIG. 12 taken along the shaft central axis.
Figure 15:
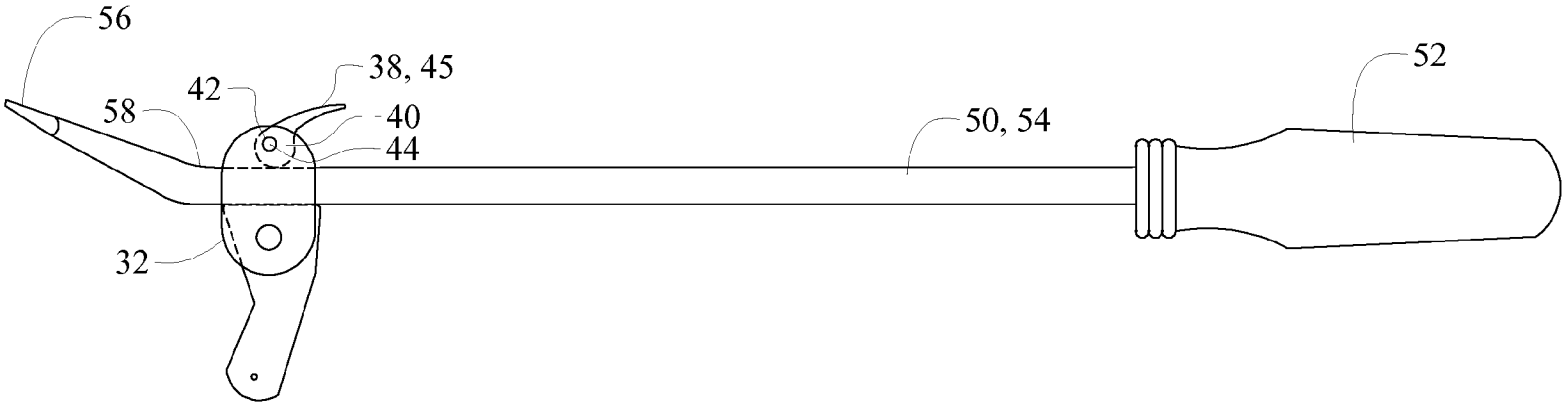
FIG. 15 is a left side plan view alternate positioning of the fulcrum as shown in FIG. 8 with the rear wall seated with the lever shaft.
Figure 16:
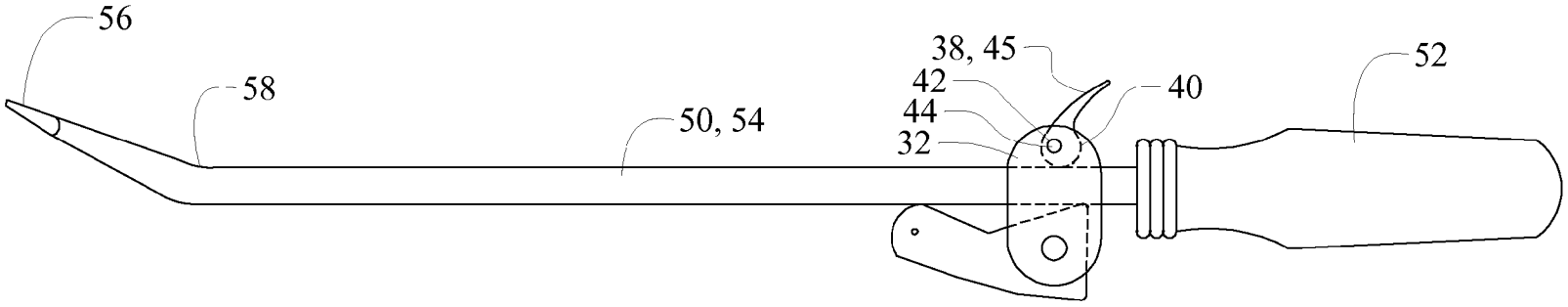
FIG. 16 is left side plan view of the fulcrum assembly of FIG. 8 shown in a storage position.
Figure 17:
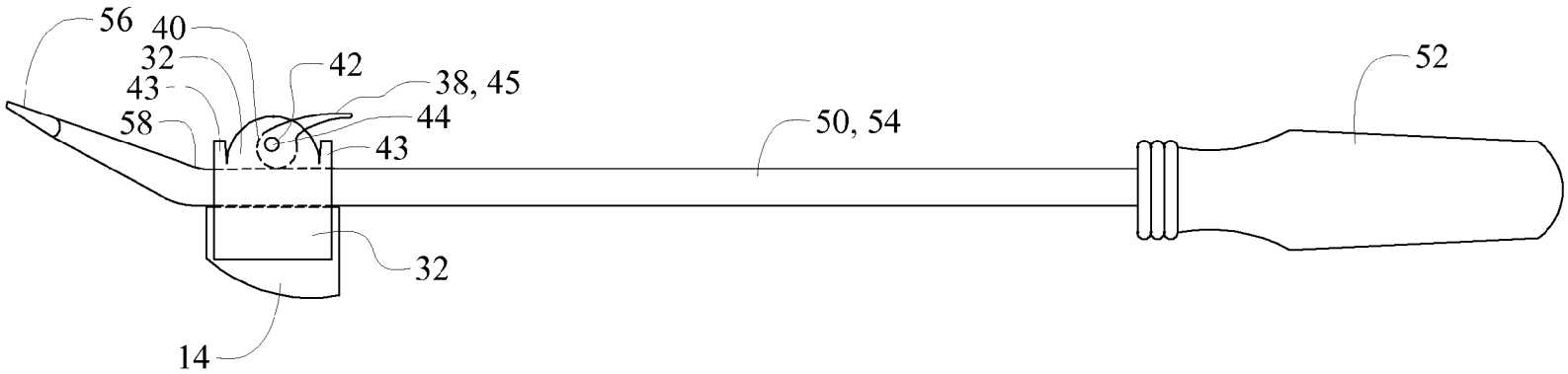
FIG. 17 is a left side plan view of a second alternative embodiment of the pry bar sliding fulcrum assembly mounted with a pry bar.
Figure 18:
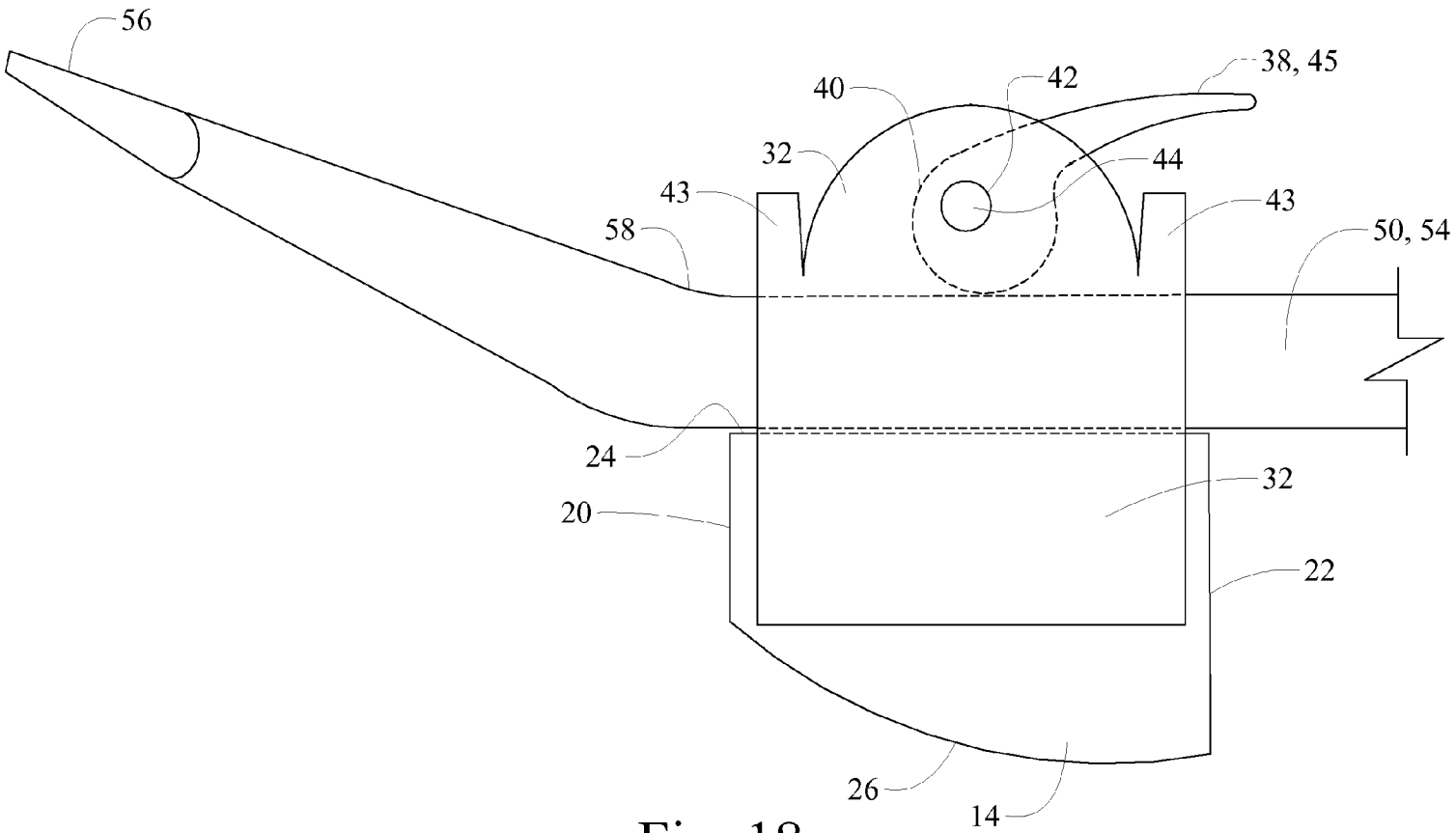
FIG. 18 is an exploded view of the end portion thereof.
Figure 19:
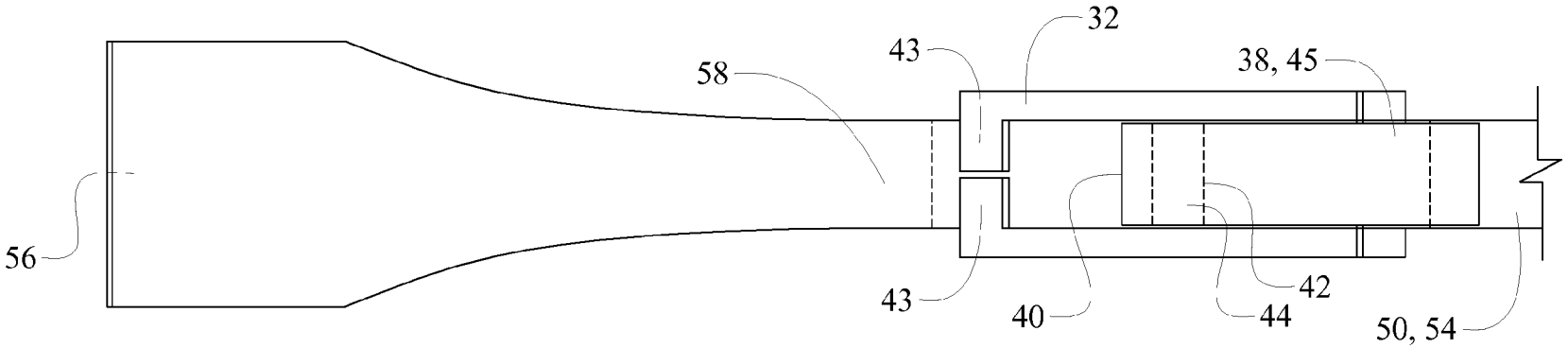
FIG. 19 is a top side plan view of the end portion of FIG. 18.
Figure 20:
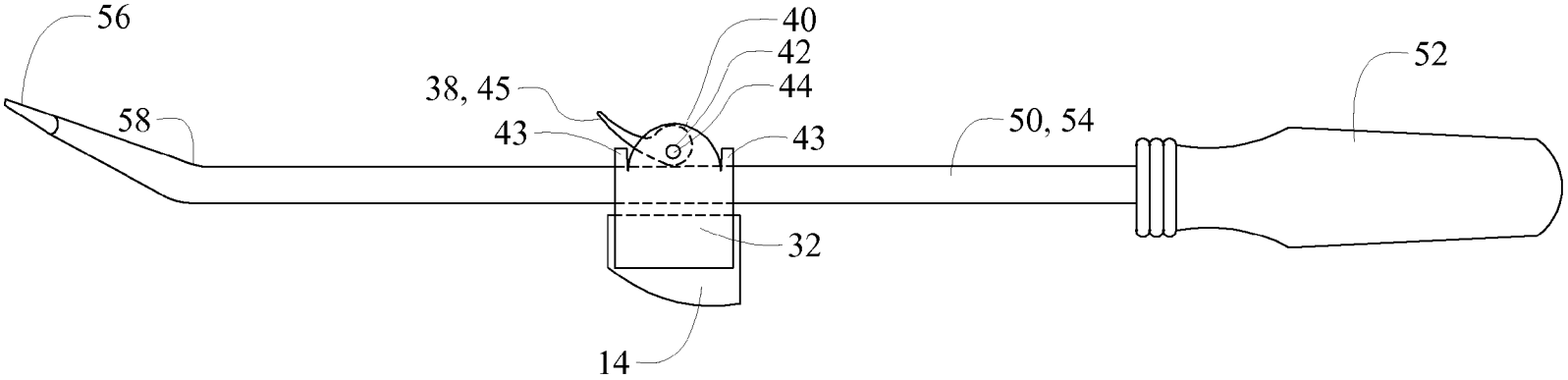
FIG. 20 is a left side plan view of the second alternative embodiment of pry bar sliding fulcrum assembly retracted and mounted with a pry bar.
Figure 21:
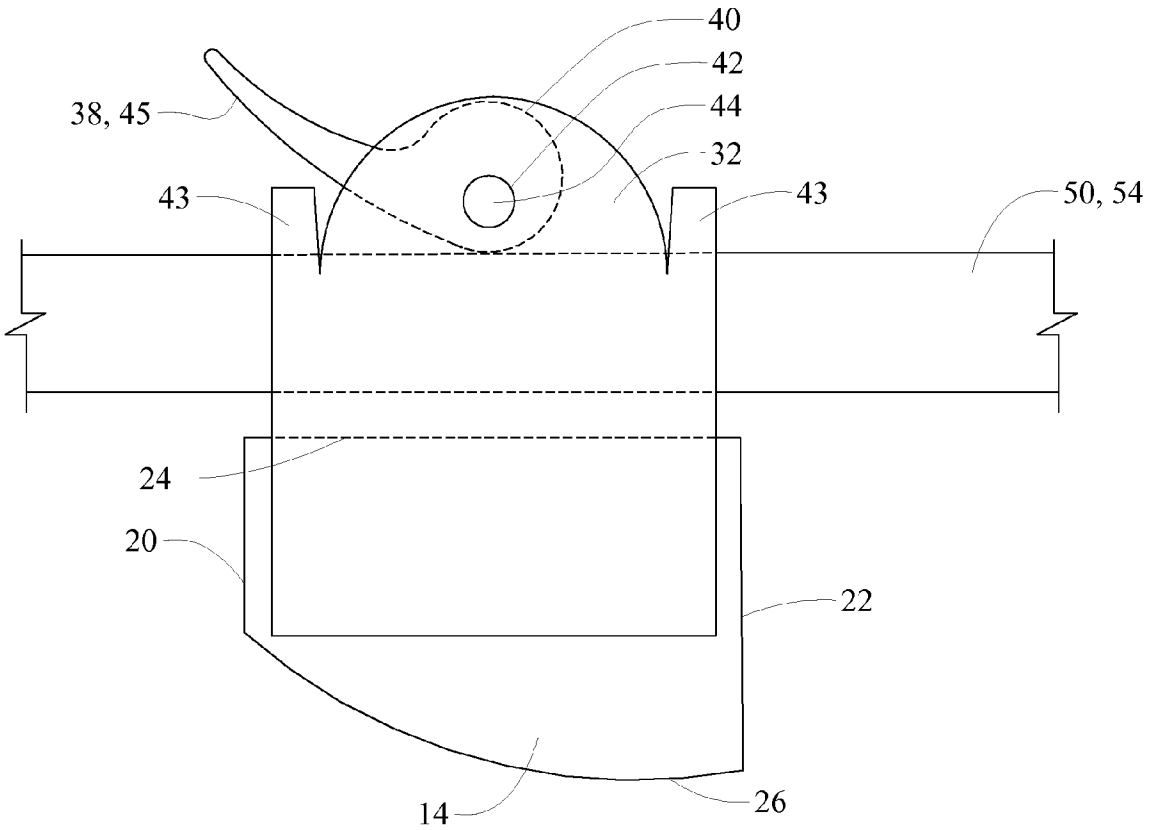
FIG. 21 is an exploded view of the pry bar sliding fulcrum assembly as depicted in FIG. 20.
Figure 22:
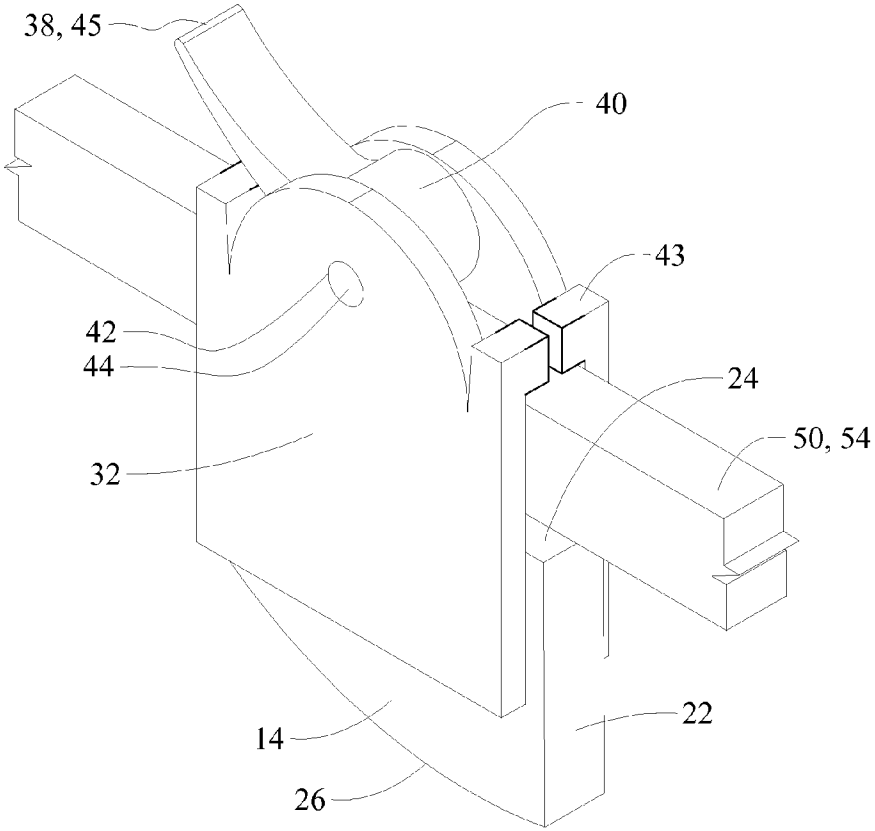
FIG. 22 is a rear perspective view of the exploded view of FIG. 18.
Figure 23:
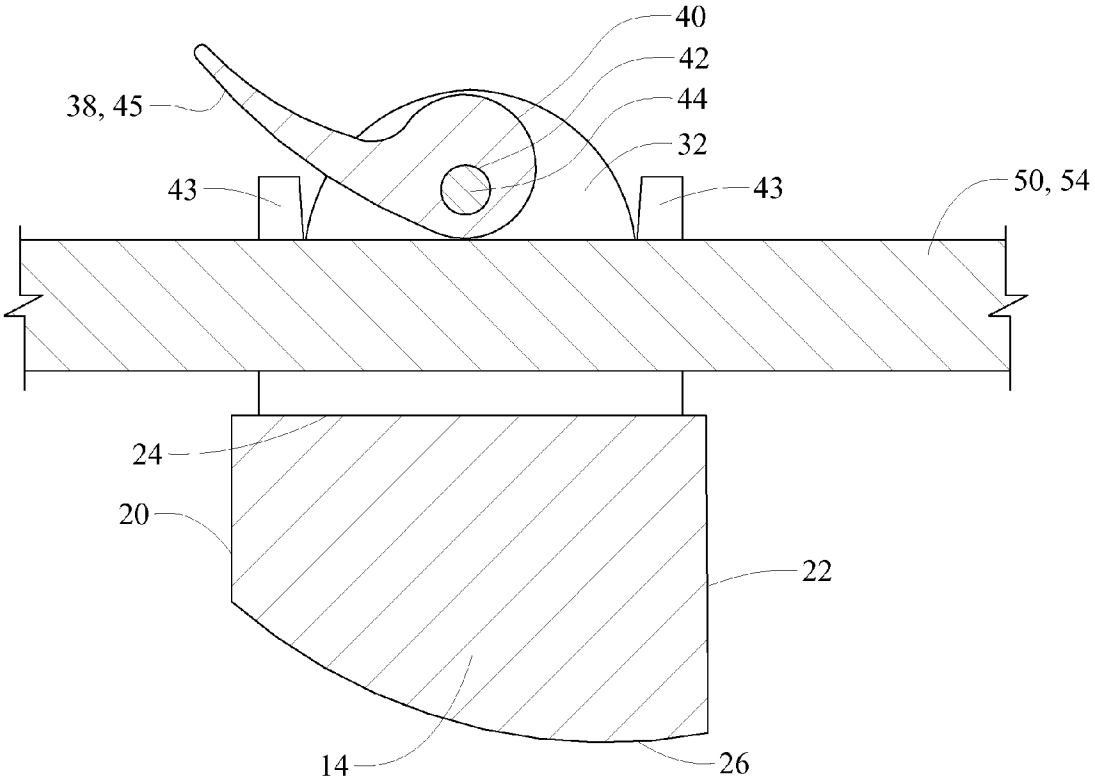
FIG. 23 is a cross sectional view of FIG. 21 taken along the shaft central axis.

Referring now to the drawings, there is shown in FIGS. 1-7 a preferred embodiment of the pry bar sliding fulcrum assembly 10 and in FIGS. 8-16 a first alternative embodiment of the pry bar sliding fulcrum assembly 10 and in FIGS. 17-23 a second alternative embodiment of the pry bar sliding fulcrum assembly 10. The assembly 10 in conjunction with a conventional prybar 50 allows a user to quickly and easily utilize the combination in order to apply a greater force and/or displacement to a work material than with a conventional prybar 50 alone.

As recognized within the relevant arts, a conventional prybar 50 comprises a handle 52, an end 56 which is typically broadened or cleaved (i.e. having a cleft), a lever shaft 54 between said handle 52 and said end 56, and a bend 58 near or at said end 56. Said bend 58 is often placed onto said shaft 54 close to said end 56 but may also be placed onto the broadened portion of the end 56.

The present art preferred embodiment represents an adjustable fulcrum assembly 10 comprising a fulcrum 14 having an optimal cross sectional shape, a saddle 32, a retainer 46, and a spring 48. A first and second alternative embodiment utilizes a cam lock 38 mounted with and/or between the saddle 32 and lever shaft 54 opposite the fulcrum 14 in order to secure the adjustable fulcrum assembly 12 at a desired location on the prybar shaft 54.

In all embodiments, the fulcrum 14 portion of the assembly 12 comprises a plate material having two sides 16 and also having a front wall 20, a rear wall 22, a bar mating wall 24, and a surface mating wall 26. The preferred embodiment also has a pivot hole 18 between the sides 16 and a spring indentation 30 on or in the bar mating wall 26. The preferred embodiment of the bar mating wall 24 also has a shape which uniquely mates with the aforesaid pry bar 50 bend 58 between the end 56 and the shaft 54. The bar mating wall 24 form provides an optimum retention of the fulcrum 14 near or at the pry bar 50 end 56 during use. That is, the fulcrum 14 will not have a substantial movement during use as it substantially seats with and conforms to the pry bar 50 bend 58. In the preferred embodiment nearest the rear wall 22, the surface mating wall 26 is substantially flat in order to follow the straight line contour of the pry bar 50 shaft 54. Although the bar mating wall 24 may be described as an arcuate or substantially "V" shaped form, for optimum retention with the preferred embodiment, the bar mating wall 24 has a shape which substantially mirrors the prybar 50 bend 58. In all embodiments, the fulcrum 14 may be comprised of two or more laminated plates 31 sandwiched together with retention via welds, crimps, adhesives, rivets or retainers 33 or other types of bonds.

An alternative embodiment of the present invention does not required the bar mating wall 24 to have a substantial mirror image of the pry bar 50 bend 58 or intimately conform to the prybar 50 bend 58 contour. Instead, the bar mating wall 24 is fashioned to seat, although not necessary in an intimate or mirror like form, with the prybar 50 shaft 54 or prybar 50 bend 58. The alternative embodiment utilizes a cam lock 38 on or mounted with the saddle 32 of the sliding fulcrum assembly 12 in order to secure the assembly 12 at a location desired by the user. The alternative embodiment is especially useful with prybars 50 which are not manufactured with a specifically defined angle between the shaft 54 and end 56. The alternative embodiment further allows fulcrum 14 attachment with the assembly 12 via welding, fasteners, or other structurally attached methods. Also in the alternative embodiment, the partially "U" shaped strap 34 of the saddle 32 may be formed by folding or bending ears 43 on the saddle 32 over or onto the prybar 50 shaft 54.

The alternative embodiment cam lock 38 comprises a radiused portion 40 which seats with and rotatably engages the shaft 54. The cam lock 38 further has a hole 42 there through which is positioned off center relative to said radiused portion 40. A pin 44 or other retainer is placed through the hole 42 and saddle 32 in order to rotatably secure the cam lock 38 with the saddle 32. The off center placement of the hole 42 assures that the cam lock 38 binds with the shaft 54 when rotated. That is, the cam lock 38 fills any space between the saddle 32 and shaft 54 and forces a frictional bind between the fulcrum assembly 12 and the shaft 54. As seen within the Figures, a lever 45 is provided with or on the cam lock 38 which allows rotation and operation of the cam lock 38.

The surface mating wall 26 also has an at least partially arcuate form 28 which allows a smooth rotation or pivot of the pry bar 50 when the surface mating wall 26 contacts a base surface relative to which a prying force is imparted upon a work material via the broadened end 56. An example would be an arcuate form 28 or surface having a partial and approximate four inch radius of curvature surface. In a preferred embodiment, the distance between the surface mating wall 26 and the bar mating wall 24 is greatest at or nearest the rear wall 22 and lesser at the front wall 20. Alternative embodiments may have varied and different distances between the surface mating wall 26 and bar mating wall 24 than the preferred embodiments which allow an optimum pivot action and further allow an optimum mating between the pry bar 50 and bar mating wall 26.

For the preferred embodiment, the fulcrum 14 is held with said pry bar 50 via a saddle 32 which mounts or mates over said shaft 54 and is pivotally secured with said fulcrum 14 via a retainer 46 such as a pin or bolt. That is in a preferred embodiment, the fulcrum 14 has a proximal pivot hole 18 through said plate sides 16 nearer said rear wall 22 than said front wall 20 through which a retainer 46 is placed through said saddle 32 and said fulcrum 14 in order to slidably secure said saddle 32 and fulcrum 14 with said prybar 50. Also in a preferred embodiment, the saddle 32 comprises an at least partially "U" shaped strap 34 having an interior dimension between the internal legs 36 of said "U" shape which is substantially equivalent to or slightly larger than the pry bar 50 shaft 54 width. The interior dimension must have sufficient tolerance relative to the shaft 54 width whereby the fulcrum assembly 12 may slide on said shaft 54. An alternative embodiment may attach the fulcrum 14 to the saddle 32 with welds or other more permanent bonding techniques and place a pin or bolt 44 through the saddle 32 and cam lock 38 opposite said fulcrum 14. Further alternative embodiments may place said cam lock 38 on the same side of the prybar 50 shaft 54 as the fulcrum 14.

In a preferred embodiment, said front wall 20 transitions between and represents a truncation of the arcuate form(s) 28 of the surface mating wall 26 and the bar mating wall 24. That is, the arcuate form(s) must truncate in order to avoid interference with the pry bar 50 end 56 during use. The position and location of said front wall 20 truncation is dependent upon the shape and size the pry bar 50. Said front wall 20 may further take a plurality of forms including but not limited to flat, angled, radiused, or recessed cuts of the plate material.

In the preferred embodiment, between said bar mating wall 24 and said pry bar shaft 54 and positioned between said rear wall 22 and an axis through the proximal pivot hole 18 which is perpendicular to said shaft 54 is placed a spring 48. The spring 48 assures and provides a positive mating force between said bar mating wall 24 and said prybar 50. The force assures that the assembly 12 is frictionally held and not loosely mated with the pry bar 50 whereby the assembly 12 will hold at any point when slid. That is, the frictional force created between at least a portion of said bar mating wall 26 and said shaft 54 or end 56 assures a positive retention of the assembly 12. Alternative embodiments may replace said spring 48 with magnets, retainers, clamps, set screws, wedges, or other mechanical elements which assure a frictional force between the fulcrum assembly 12 and the prybar 50 shaft 54.

The aforesaid preferred embodiment arrangement requires that when seated with said bend 58, the bar mating wall 24 at or aft of said proximal pivot hole 18 or retainer 46 (i.e. between said retainer and rear wall 22) have a gap between said shaft 54 and said bar mating wall 24. The gap allows said fulcrum 14 to pivot on said retainer 46 and relative to said saddle 32 when the assembly 12 is retracted from the bend 58 portion. If a gap was not present, the bar mating wall 24 nearest said rear wall 22 would bind with the shaft 54 and preclude sliding of the assembly 12.

In the preferred embodiment, the spring 48 is of a compressed coil spring form, i.e. compression spring, which is held or retained within an indentation, recess, or short bore 30 within the bar mating wall 24 of the fulcrum 14. The recess 30 houses and captures said spring 48 when assembled. That is, said spring 48 has sufficient length that when assembled and said retainer 46, i.e. bolt or pin, is placed it cannot escape from the assembly 12. Alternative embodiments may utilize springs 48 of a plurality of shapes and forms including but not limited to torsion and leaf forms. With alternative embodiment springs 48, said recess 30 may take a plurality of cross sectional forms other than circular. Furthermore, said alternative embodiment spring 48 may attach directly to said fulcrum 14 via fasteners or welds and/or not utilize a recess and further may have a ball or other material between the spring 48 and prybar 50 shaft 54 in order to prevent binding. Still further embodiments may utilize a magnetic element between the bar mating wall 24 and the shaft 54 or end or magnetize the fulcrum 14 in order to frictionally hold the fulcrum 14 with the prybar 50.

A further alternative embodiment places said spring 48 between the base of the "U" of the saddle 32 and the shaft 54. That is, the spring 48 compressively tensions the saddle 32 and forces the fulcrum 14 into contact with the shaft 54 whereby a frictional contact exists between the fulcrum 14 and shaft 54. In the preferred embodiment, a frictional contact exists between the saddle "U" strap 34 and the shaft 54. As with the preferred embodiment, the alternative embodiment may utilize springs 48 which include but are not limited to coil, leaf, or torsional types.

Unique to the embodiment of FIGS. 8-16, the fulcrum 14 may be rotated whereby the rear wall 22 substantially or at least partially seats or contacts with the lever shaft 54 or end 56. This arrangement provides the full fulcrum 14 length from the rear wall 22 to the front wall 20 as a displacement at or near the prybar 50 end 56. That is, the cam lock 38 has sufficient displacement when rotated to a non-binding position that the fulcrum 14 may rotate approximately 90 degrees from a storage position, allow a portion of the rear wall 22 to contact the shaft 54 or end 56, and thereafter be bound and secured into position via cam lock 38 rotation to a binding position.

Figure 24:
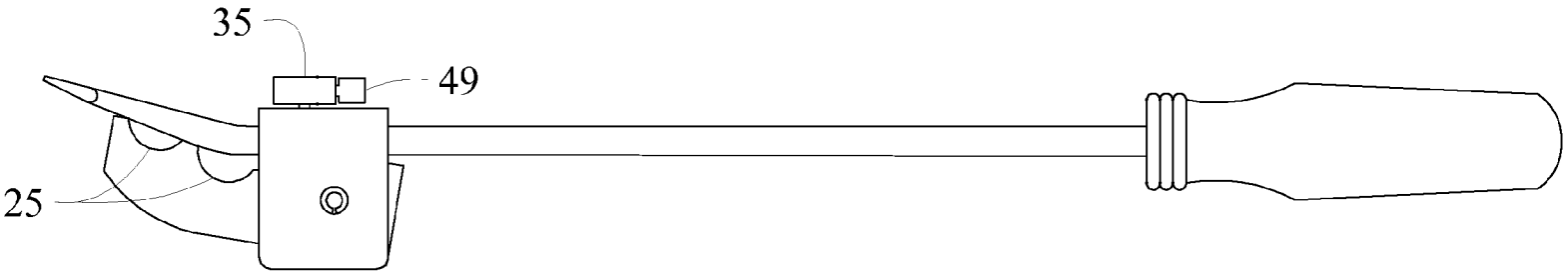
FIG. 24 is a left side plan view of a third alternative embodiment of the pry bar sliding fulcrum assembly mounted with a pry bar.
Figure 25:
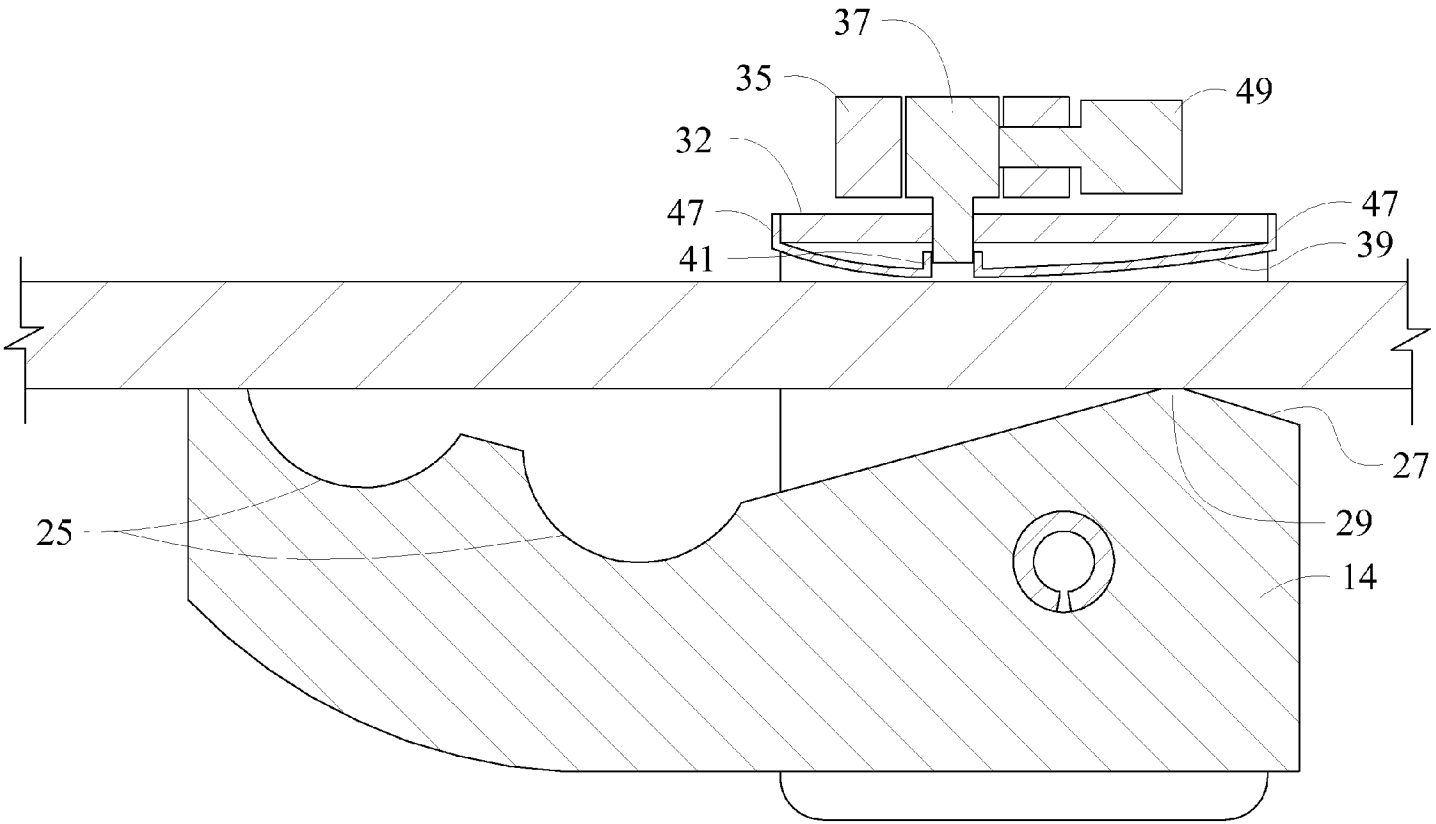
FIG. 25 is a cross sectional view of FIG. 24 taken along the shaft central axis.
Figure 26:
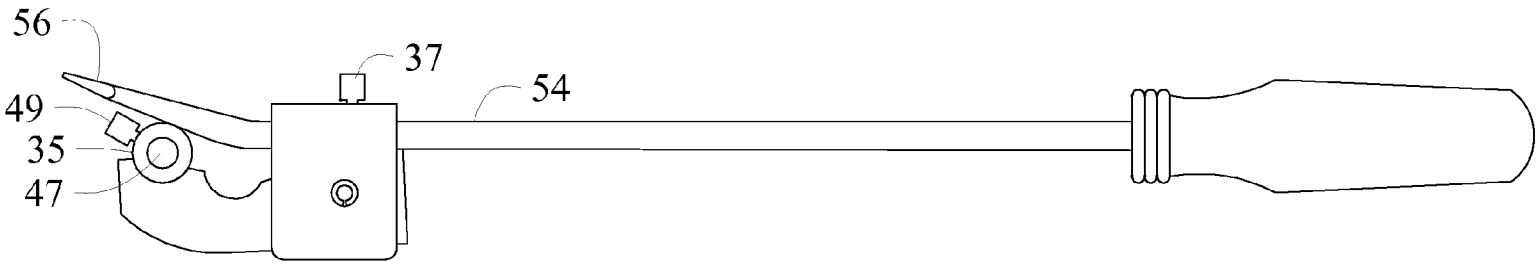
FIG. 26 is a left side plan view of the pry bar sliding fulcrum assembly of FIG. 24 with the bar mating wall spacer inserted.
Figure 27:
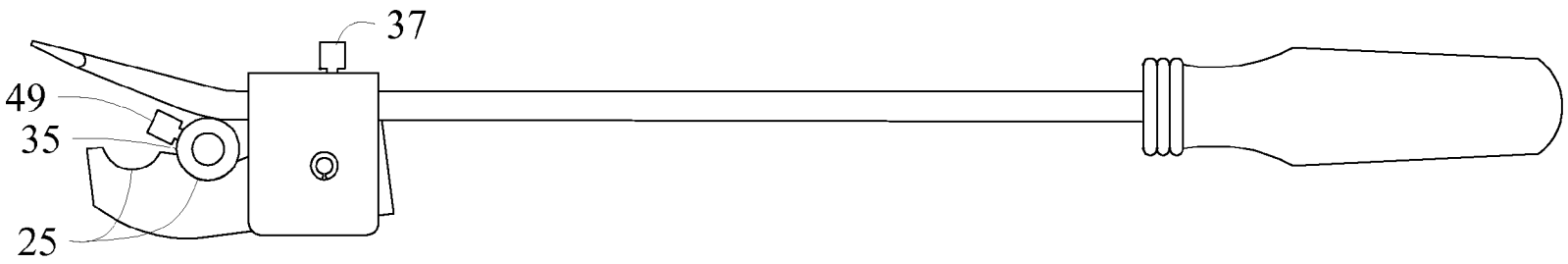
FIG. 27 is a left side plan view of the pry bar sliding fulcrum assembly of FIG. 24 with the bar mating wall spacer inserted.

Referring now to FIGS. 24-27, there is shown a further alternative embodiment which utilizes a bar mating wall spacer 35 positioned within one or more bar mating wall recesses 25 between the bar mating wall 24 and the lever shaft 54 or the broadened end 56 in order to provide a greater separation distance between the surface mating wall 26 and the lever shaft 54 or broadened end 56. The recesses 25 as shown are semicircular in shape but may take a plurality of forms including but not limited to "V", "U", triangular, and rectangular shapes. The bar mating wall spacer 35 is preferably of a circular a shape but may comprise a plurality of shapes which at least partially mate with said recess 25. This alternative embodiment provides an even greater range of displacement at the broadened end due to the increased effective fulcrum 14 thickness or displacement between the prybar 50 and the underlying base material work. This further alternative embodiment comprises a substantially "V" shaped bar mating wall 24 with a counter cut 27 nearest the rear wall 22 which resembles a pinnacle 29 there between. This geometric form allows a greater pivot angle of the fulcrum 14 on the retainer 46 and a greater separation of the bar mating wall 24 and the lever shaft 54 or broadened end 56 whereby the spacer 35 may be inserted there between.

The spacer 35 preferably has a hole 47 therein and a spacer retainer 49 (i.e. such as a set screw or thumb screw) or other type of retainer which allows the spacer 35 to be easily stowed or fitted upon or with a saddle set screw 37 when not utilized. The spacer retainer 49 may take a plurality of forms including but not limited to pins, set screws, frictional fits, magnetic adhesion, or chemical adhesion. The spacer 35 may further be magnetized in order to assure retention when utilized or stowed. This alternative embodiment has a saddle set screw 37 threaded with the saddle 32 in order to retain the saddle 32 in a specific position and also retain the spacer 35 between the bar mating wall recesses 25. That is, when tightened, the saddle set screw 37 provides a saddle 32 force substantially perpendicular to the lever shaft 54 thereby increasing the friction between the fulcrum assembly 12 and the lever shaft 54. Further alternative embodiments may utilize elements distinct from a setscrew 37 in order to provide said force. These include but are not limited to pins, cams, levers, or wedges.

A saddle spring 39 positioned between the saddle 32 and the lever shaft 54 is retained by said saddle set screw 37 via a retention hole 41 within the saddle spring 39 and/or one or more lips 47 positioned at least partially around the saddle 32 edges. The saddle spring 39 further serves to provide a part or all of the aforesaid force without the need for saddle set screw 37 tightening. The saddle spring 39 is preferably of a leaf spring form but may take a plurality of forms including but not limited to coil and torsional springs. The saddle spring 39, via the force imparted, further provides the desired frictional interface between the fulcrum assembly 12 and the prybar 50 in order to limit any undesired assembly 12 movement. Further alternative embodiments may utilize only a set screw 37 or a saddle spring 39 in lieu of both. The saddle set screw 37 is preferably positioned away from the center position or axis of the saddle 32 in order to minimize binding between the saddle 32 and the lever shaft 52.

In operation, the user slides the fulcrum assembly 12 towards the pry bar 50 end 56 in order to position the assembly 12 for use. For the preferred embodiment, the bar mating wall 24 is seated with the prybar 50 bend 58 whereby it remains substantially stationary during use. For the alternative embodiments, the user positions the assembly 12 near the end as desired and rotates the cam lock 38 in order to bind the fulcrum assembly 12 with the prybar 50. For the third alternative embodiment, the user positions the assembly 12 near the end as desired and inserts the bar mating wall spacer 35 between the bar mating wall 24 and the lever shaft 54 or end 56 and within a bar mating wall recess 25. If desired or necessary, the saddle set screw 37 is then tightened to secure the spacer 35. The user then places the surface mating wall 26 onto the work surface, positions the prybar 50 end 56 onto the work, and applies a force onto the handle 52. When finished, the user may retract the fulcrum assembly 12 toward the handle 52 and further utilize the apparatus as a conventional prybar 50. For the first and second alternative embodiments, if the user desires even greater displacement capability of the apparatus 10, he or she may loosen the cam lock 38 sufficiently whereby the fulcrum 14 may rotate and substantially seat the rear wall 22 with the shaft 54 or end 56. Rotation of the cam lock 38 secures the assembly 12 into position and allows the user to place at least a portion of the front wall 20 onto the work surface during the aforesaid operation, thereby providing greater end 56 displacement when necessary.

The art of the present invention 10 may be adapted to a plurality of prybar 50 styles and forms, including but not limited to wrecking bars, demolition bars, molding lifters, nail pullers, claw bars, and shingle removers while providing all of the aforesaid benefits.

Having described the invention in detail, those skilled in the art will appreciate that modifications may be made to the invention and its method of use without departing from the spirit herein identified. Therefore, it is not intended that the scope of the invention be limited to the specific embodiments illustrated and described. Rather, it is intended that the scope of this invention be determined by the appended claims and their equivalents.

What is claimed is:

1. A pry bar sliding fulcrum assembly in combination with a prybar, the combination comprising:

a prybar having a handle, an end, a shaft between said handle and end, and a bend between said end and said shaft; and an adjustable fulcrum assembly comprising a fulcrum and a saddle; and said fulcrum having sides, a front wall, a rear wall, a bar mating wall, a surface mating wall having a partially acuate form, and a proximal pivot hole through said sides nearer said rear wall; and said bar mating wall having a shape which at least partially mates with said prybar bend; and said saddle having a partially "U" shaped strap with at least two legs, said legs having an interior dimension between said legs substantially equivalent to or slightly larger than said prybar shaft and slidably positioned around said shaft; and said fulcrum and saddle having a retainer through said saddle and said proximal pivot hole of said fulcrum which pivotally secures said fulcrum with said saddle and allows said fulcrum assembly to slide on said shaft; and said bar mating wall having a gap between said retainer and said rear wall and said shaft whereby said fulcrum may pivot on said saddle without binding with said shaft whereby said fulcrum assembly may slide from near said handle towards said end, substantially mate with said bend, and thereafter allow placement of said surface mating wall onto a work surface and provision of a greater force and displacement of said end when a force is applied onto said handle.

2. The pry bar sliding fulcrum assembly in combination with a prybar as set forth in claim 1, further comprising:

a spring between said bar mating wall and said prybar shaft; and said spring providing a positive mating force between said bar mating wall and said prybar whereby said assembly is frictionally held with said prybar when slid.

3. The pry bar sliding fulcrum assembly in combination with a prybar as set forth in claim 2, further comprising:

a recess within said bar mating wall within which said spring is housed.

4. An pry bar sliding fulcrum assembly comprising:

an adjustable fulcrum assembly comprising a fulcrum and a saddle; and said fulcrum having sides, a front wall, a rear wall, a bar mating wall, and a surface mating wall having a partially acuate form; and said bar mating wall having a shape capable of at least partially seating with a bend or a shaft of a prybar; and said saddle having a partially "U" shaped strap with at least two legs, said legs having an interior dimension between said legs substantially equivalent to or slightly larger than a prybar shaft and slidably positionable around said prybar shaft; and a cam lock having a radiused portion and an off center hole relative to said radiused portion and a pin rotatably holding said cam lock through said off center hole and with said saddle, said cam lock capable of binding with said prybar shaft when rotated and substantially holding said fulcrum assembly with said prybar; and said fulcrum substantially retained with said saddle whereby said fulcrum assembly may slide on said prybar shaft; and said bar mating wall having a gap relative to said prybar shaft when said cam lock is rotated to a position which does not bind with said prybar shaft, whereby said fulcrum assembly may slide from near a prybar handle towards a prybar end and thereafter allow placement of said surface mating wall onto a work surface and provision of a greater force and displacement of said prybar end when a force is applied onto said prybar handle.

5. The pry bar sliding fulcrum assembly as set forth in claim 4, further comprising:

one or more ears on said saddle which form said at least partially "U" shaped strap when folded or bent.

6. The pry bar sliding fulcrum assembly as set forth in claim 4, further comprising:

said cam lock having sufficient displacement whereby said fulcrum may be rotated into a position whereby at least a portion of said rear wall seats with said prybar shaft or end when said cam lock binds with said prybar shaft and thereafter allow placement of at least a portion of said front wall onto said work surface and provision of a greater displacement of said prybar end when a force is applied onto said prybar handle.

7. A pry bar sliding fulcrum assembly comprising:

an adjustable fulcrum assembly comprising a fulcrum and a saddle; and said fulcrum having sides, a front wall, a rear wall, a bar mating wall having a partially "V" shaped form, and a surface mating wall; and said bar mating wall having one or more recesses nearer said front wall than said rear wall wherein a bar mating wall spacer may be inserted and held between said bar mating wall and a pry bar shaft or a pry bar broadened end; and said bar mating wall spacer having a shape which at least partially mates with said recess; and said saddle having a partially "U" shaped strap with at least two legs, said legs having an interior dimension between said legs substantially equivalent to or slightly larger than said pry bar shaft and slidably positionable around said pry bar shaft; and said fulcrum and saddle having a retainer which pivotally secures said fulcrum with said saddle and allows said fulcrum assembly to slide on said pry bar shaft; and said bar mating wall having a gap relative to said pry bar shaft, between said retainer and said rear wall, whereby said fulcrum may pivot on said saddle without binding with said shaft whereby said fulcrum assembly may slide from near a pry bar handle towards a pry bar end and thereafter allow placement of said surface mating wall onto a work surface and provision of a greater force and displacement of said pry bar end when a force is applied onto said pry bar handle.

8. The pry bar sliding fulcrum assembly as set forth in claim 7, further comprising:

a spring between said saddle and said shaft wherein said spring provides a positive mating force between said saddle and said pry bar whereby said assembly is frictionally held with said pry bar when slid.

9. The pry bar sliding fulcrum assembly as set forth in claim 8, whereby:

said spring comprises a leaf spring.

10. The pry bar sliding fulcrum assembly as set forth in claim 8, further comprising:

a saddle set screw threaded and positioned within said saddle and capable of imparting a force between said lever shaft and said saddle.

11. The pry bar sliding fulcrum assembly as set forth in claim 8, whereby:

said bar mating wall spacer has a circular shape.

12. The pry bar sliding fulcrum assembly as set forth in claim 10, whereby:

said bar mating wall spacer has a circular shape.

13. The pry bar sliding fulcrum assembly as set forth in claim 12, whereby:

said spacer has a spacer hole capable of fitting with a portion of said saddle set screw.

14. The pry bar sliding fulcrum assembly as set forth in claim 13, whereby:

said spacer has a spacer set screw within said spacer wherein said spacer may be retained with said saddle set screw.

15. The pry bar sliding fulcrum assembly as set forth in claim 9, whereby:

said leaf spring has one or more lips positioned at least partially around an edge of said saddle.

16. The pry bar sliding fulcrum assembly as set forth in claim 8, whereby:

said spring has one or more spring retention holes wherein said saddle set screw retains said spring.

17. The pry bar sliding fulcrum assembly as set forth in claim 16, whereby:

said spring is a leaf spring having one or more lips positioned at least partially around an edge of said saddle.

* * * * *